US007882976B1

(12) United States Patent
Goede

(10) Patent No.: US 7,882,976 B1
(45) Date of Patent: Feb. 8, 2011

(54) CONTAINER CAP SYSTEM WITH RELEASABLE MODIFICATION COMPOSITION

(76) Inventor: Armand Jean Goede, 397 Wekiva Springs Rd., Suite 225, Longwood, FL (US) 32779

( * ) Notice: Subject to any disclaimer, the term of this patent is extended or adjusted under 35 U.S.C. 154(b) by 321 days.

(21) Appl. No.: 11/873,135

(22) Filed: Oct. 16, 2007

(51) Int. Cl.
*B65D 51/20* (2006.01)

(52) U.S. Cl. ..... 220/258.1; 215/DIG. 8; 206/222

(58) Field of Classification Search ..... 220/258.4, 220/303, 258.1, 258.3, 717, 705; 206/219, 206/222, 220; 215/227, DIG. 8, 387; 222/80, 222/145.1, 521
See application file for complete search history.

(56) References Cited

U.S. PATENT DOCUMENTS 6,152,296 A * 11/2000 Shih ..... 206/222
6,758,359 B2 * 7/2004 Yurkewicz et al. ..... 215/251
6,959,839 B2 * 11/2005 Roth et al. ..... 222/83
7,249,690 B2 * 7/2007 Smith et al. ..... 222/83
2004/0020797 A1 * 2/2004 Fontana ..... 206/219
2005/0126632 A1 6/2005 Farrell et al. ..... 137/ 155

* cited by examiner

*Primary Examiner*—Anthony Stashick
*Assistant Examiner*—Jeffrey Allen
(74) *Attorney, Agent, or Firm*—Albert Bordas, P.A.

(57) ABSTRACT

A cap for modifying the contents of a container with a modifying composition. The cap system permits a user to agitate the contents of the container without spillage. A collar assembly is removably mounted to the neck of a container and an elongated plunger shank is partially housed therein with a compartment for storing the composition. Upon the application of force on the plunger shank, the foil sheet covering the bottom hits the puncturing protrusion of the activator assembly, releasing the modification composition while maintaining the container in watertight condition preventing any spillage if shaken. The seal previously achieved by the shank is not being achieved by the valve seat of the spout assembly.

4 Claims, 5 Drawing Sheets

CONTAINER CAP SYSTEM WITH RELEASABLE MODIFICATION COMPOSITION

BACKGROUND OF THE INVENTION

1. Field of the Invention

The present invention relates to a cap system for containers with a releasable modification composition, and more particularly, to the type that permits a user to agitate the containers to mix its contents without spillage.

2. Description of the Related Art

Several designs for beverage modification systems have been designed in the past. None of them, however, permits a user to agitate the container after the modification composition is released.

Applicant believes that the closest reference corresponds to U.S. patent publication No. 2005/0126632 A1 issued to Farrell et al for a beverage modification system. A cap system containing a pouch is secured to the opening of a container. When the pouch is activated the modified composition is released and mixes with the beverage. However, it differs from the present invention because once sheet 49 of compartment assembly 40 is broken, a user would have to use his/her fingers, typically his/her thumb, to prevent the contents from spilling out if the mixture is to be agitated.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a beverage modification system that permits a user to agitate the container without spillage, in one end position of its plunger at the central through opening.

It is another object of this invention to provide a beverage modification system that can be readily used.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
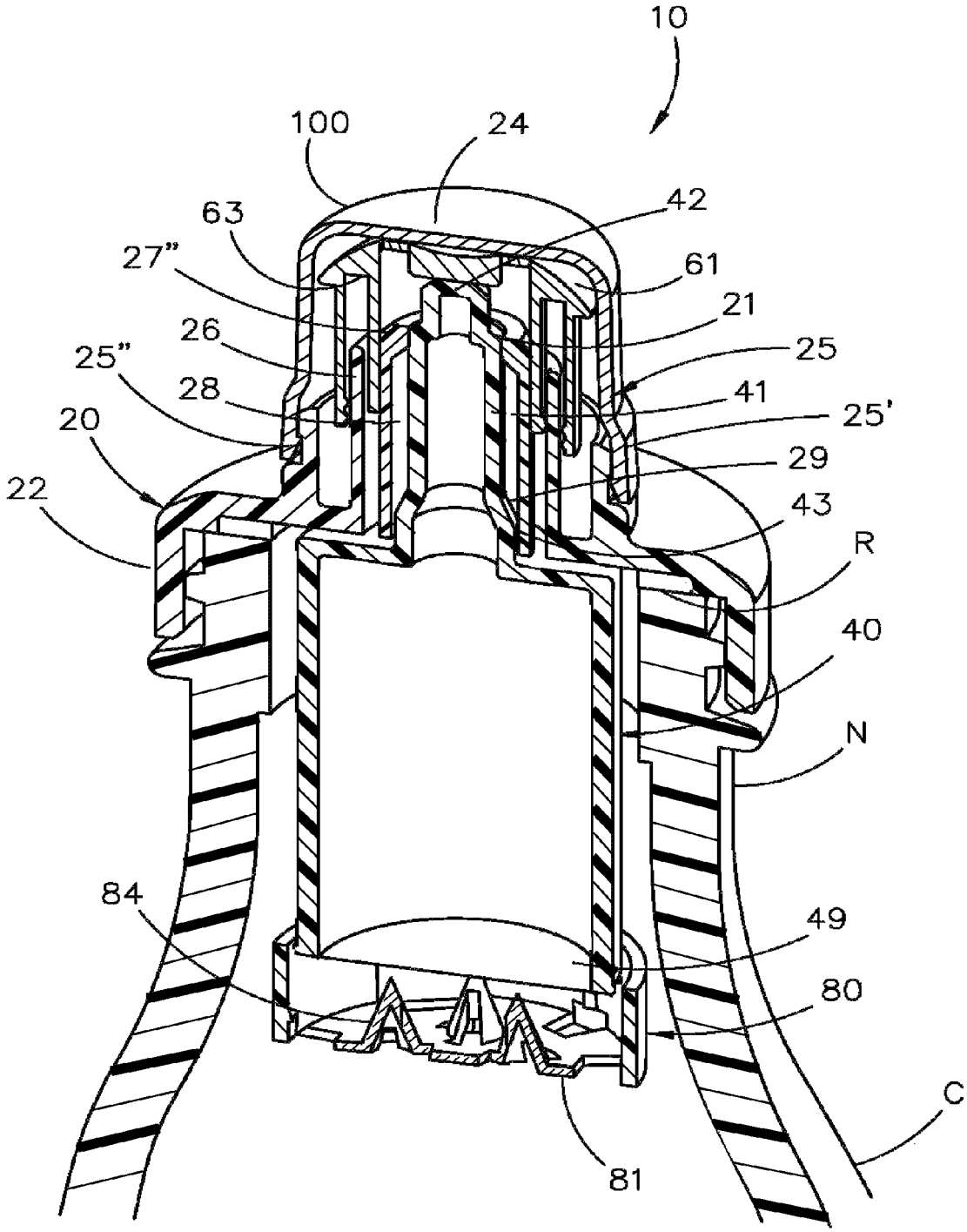
FIG. 1 represents an isometric view with a cross-section of the preferred embodiment before use, in shipping or storage position, with the cap system mounted to the container's neck.

Referring now to the drawings, where the present invention is generally referred to with numeral 10, it can be observed that it basically includes collar assembly 20 coaxially and removably mounted on the upper end neck N of container C, canister compartment assembly 40 coaxially mounted within assembly 20, movable spout assembly 60 and cover assembly 100.

As shown in FIG. 1, cap 10 is mounted next to the opening of container C's neck N. Collar assembly 20 in one of the preferred embodiment, includes peripheral skirt 22 that cooperates with the areas next to the opening in neck N. In one of the preferred embodiments, a frictional engagement can provide sufficient grip to keep assembly 20 affixed to neck N. An alternative could be a threaded neck with a mating internal thread on skirt 22. Upper wall 24, with a central through opening 21, of assembly 20 provides support for outer annular member 25 which is coaxially disposed with respect to assembly 20 and extends outwardly and perpendicularly from wall 24. The outer surface 25' of member 25 includes a mechanism for releasably engaging cover assembly 100, such as locking protrusion 25". Next to outer annular member 25 is central annular member 26 which also extends perpendicularly from wall 24 and is also coaxially disposed with respect to assembly 20 and member 25. Member 26 includes inward flange 26'. Member 26 is inwardly spaced a predetermined distance that is kept uniformly around its entire periphery. And inner annular member 27 also extends perpendicularly from wall 24 and it is coaxially disposed with respect to assembly 20 and member 25 and 26, keeping a predetermined spaced apart relationship with respect to member 26. The inner surface 27' of inner annular member 27 defines a cylindrical passage 28 with a constrained portion 28' defined by inwardly extending peripheral flange 27" of annular member 27.

Compartment assembly 40 has a substantially cylindrical shape in one of the preferred embodiments with one end including a plunger shaft 41 with end 42 having a reduced diameter portion 42' (relative to shaft 41) and the other end 43 having an enlarged portion. Plunger shaft 41 is coaxially disposed within passage 28 and guided therein to slidably travel between two extreme positions. The other end of assembly 40 has an opening that is covered with a relatively thin sheet 49 of a suitable material that is susceptible to being punctured upon the application of a force of predetermined magnitude, such as aluminum foil.

Figure 2:
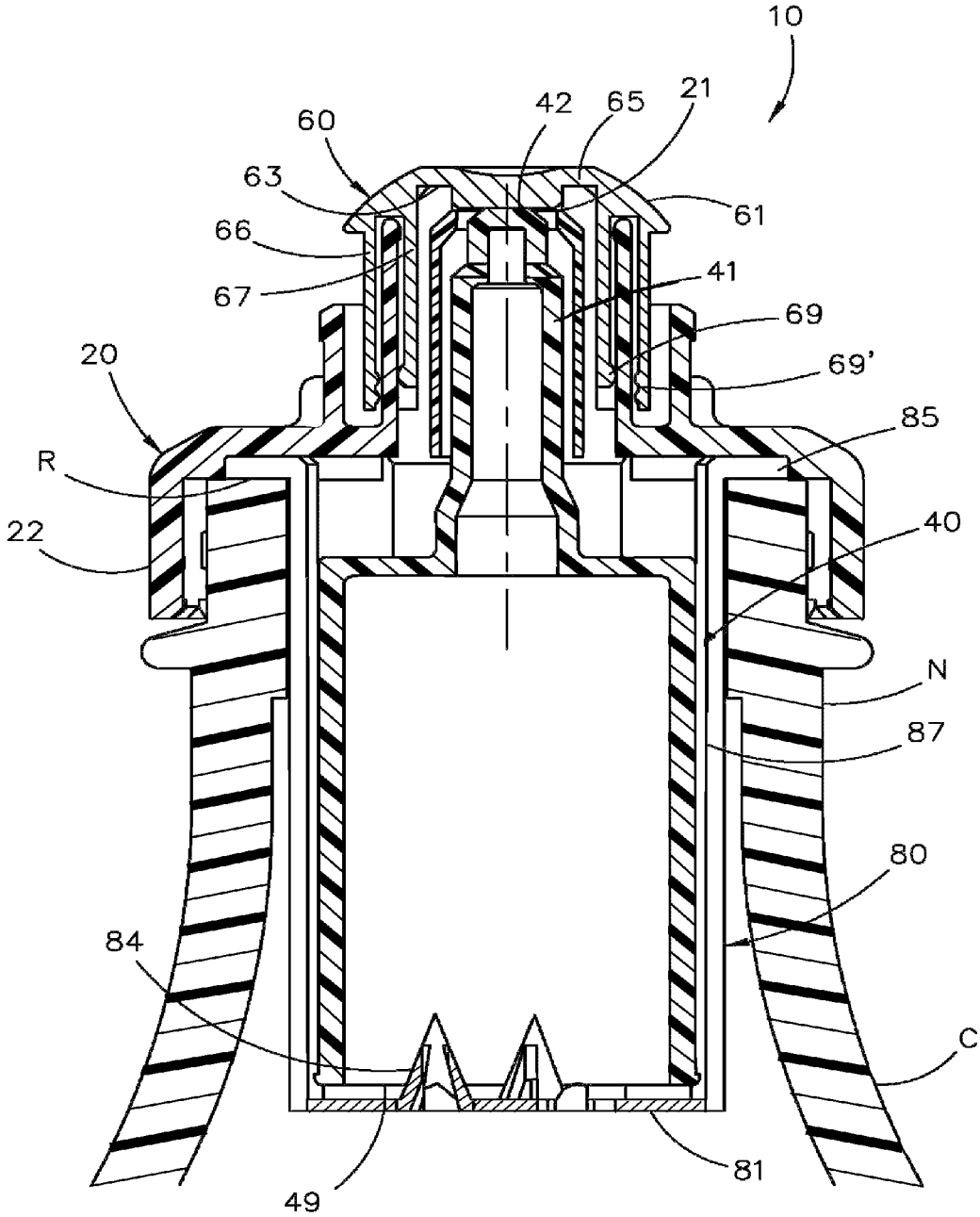
FIG. 2 shows an elevational cross-section of the cap shown in the previous figure without cover 100 and in the position that permits a user to shake container C without spillage.
Figure 3:
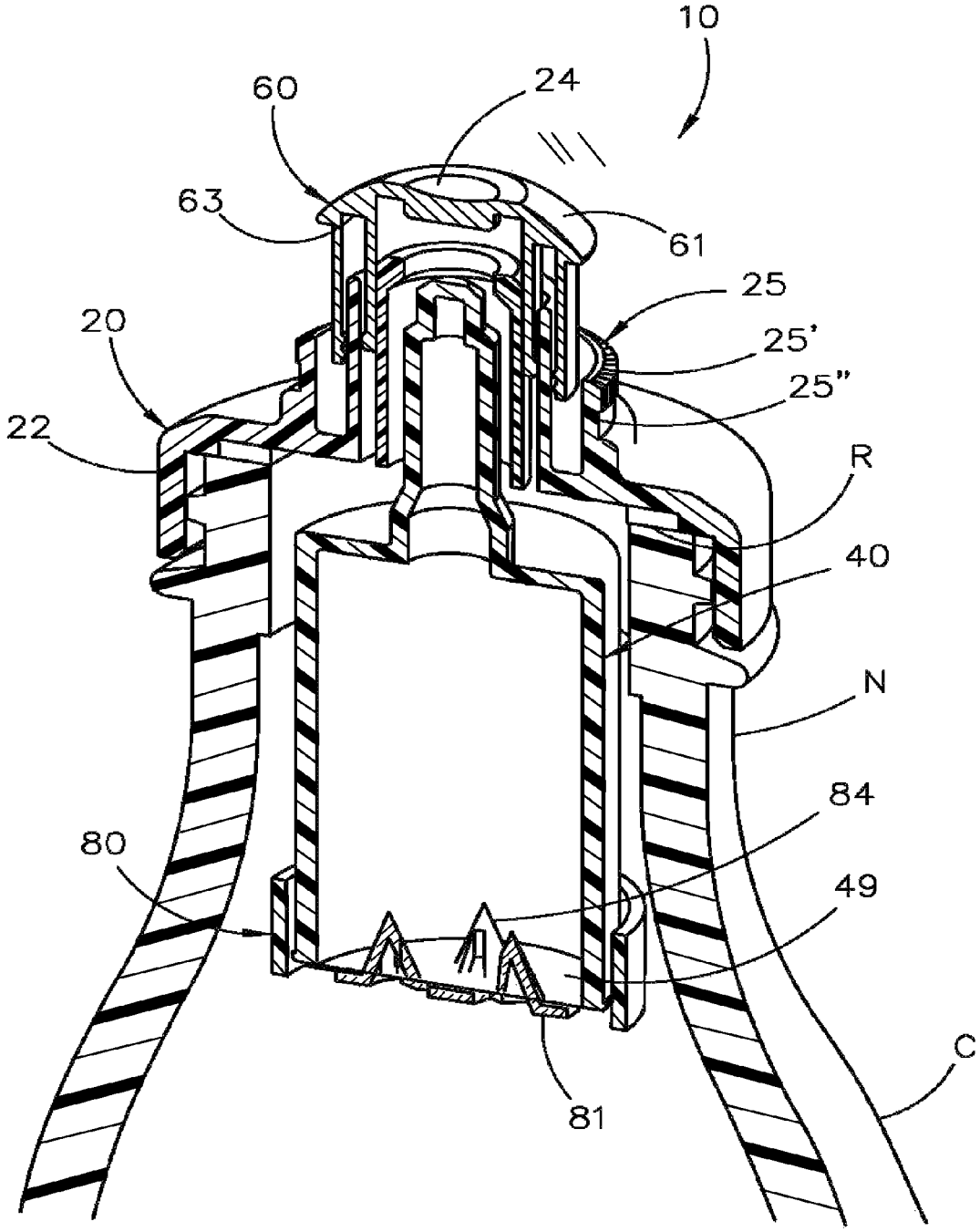
FIG. 3 illustrates an isometric view with a cross-section of the cap shown in the previous figure and the canister locked in the down position with the pierced foil bottom and dispensing the modification composition into the container's contents.

In one of the extreme positions, as shown in FIG. 1, compartment assembly 40 comes in contact with the underside of assembly 20 and end 42 extends beyond peripheral flanges 27". In this extreme position, passage 28 is closed to the outside by the abutting relationship between shaft 41 and flange 27" as well as end 43 to the end 29 of passage 28. In the other extreme position, as shown in FIG. 2, compartment assembly 40 is separated from the underside of assembly 20 and end 42 leaves the constrained portion 28' thereby opening passage 28 to the outside. In this manner, the two extreme positions position provide for sealing passage 28 and opening it.

Figure 4:
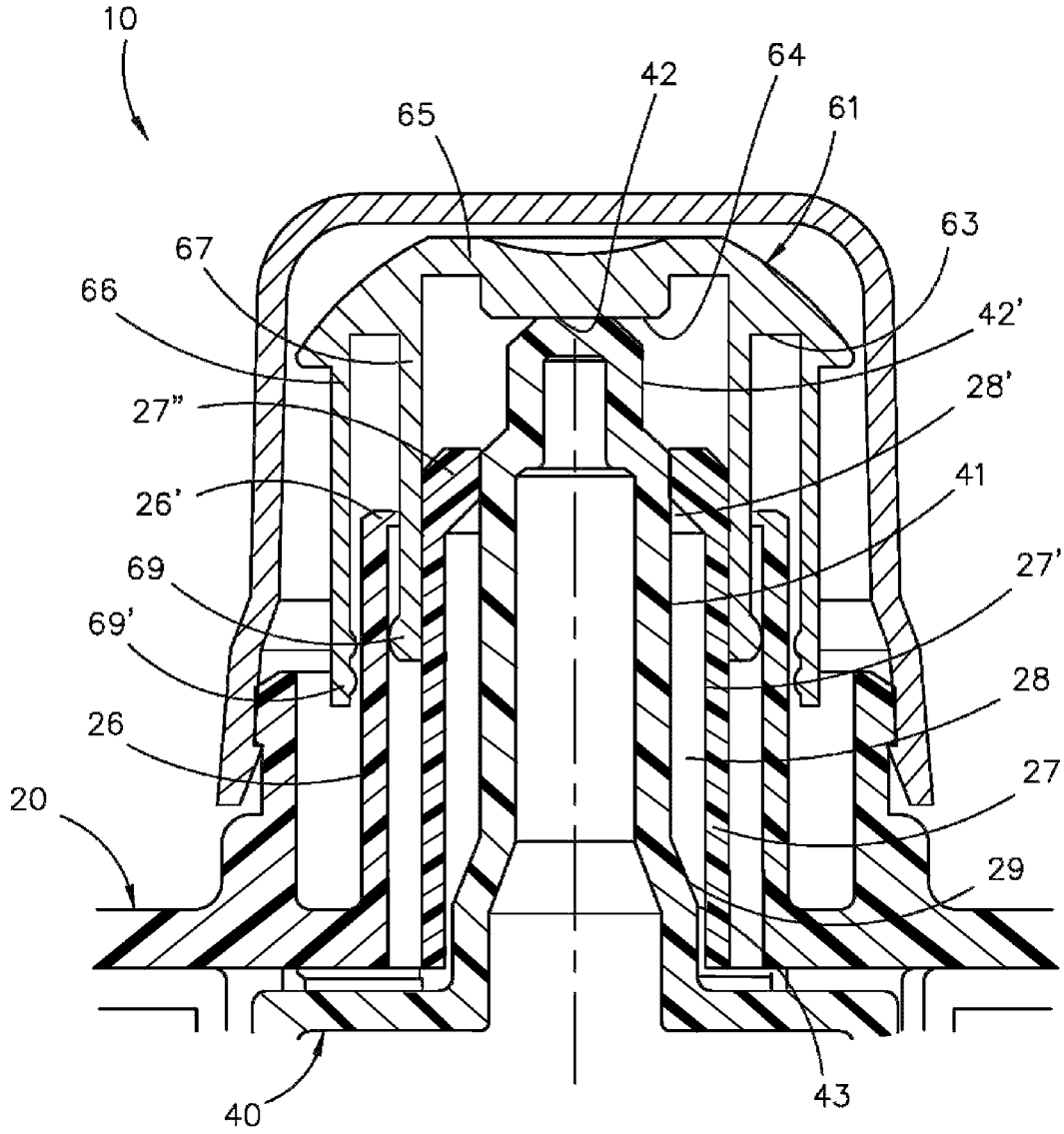
FIG. 4 is a partial and enlarged elevational cross-section of a portion of FIG. 3 showing part of the collar assembly and spout assembly with the shaft closing the central passage of the collar assembly.
Figure 5:
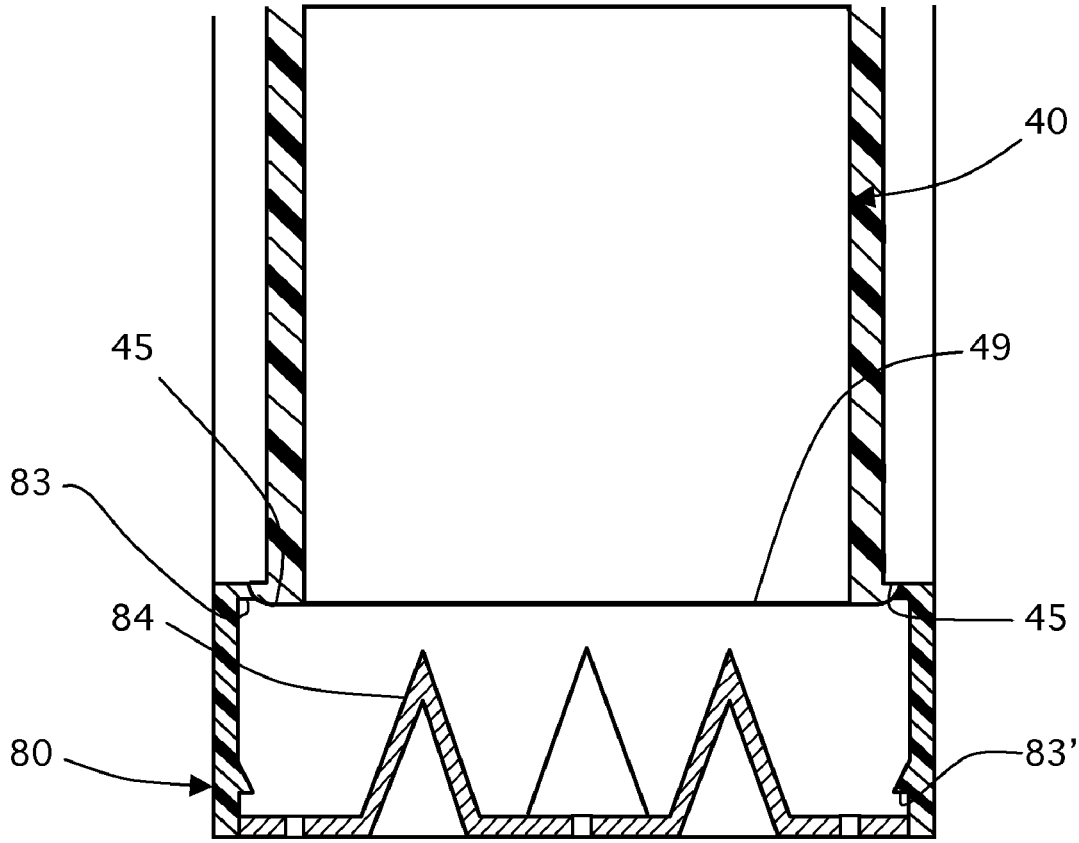
FIG. 5 is a detail cross-section of the lowermost portion of a compartment showing the stopper lips that suspend the compartment in place.
Figure 5A:
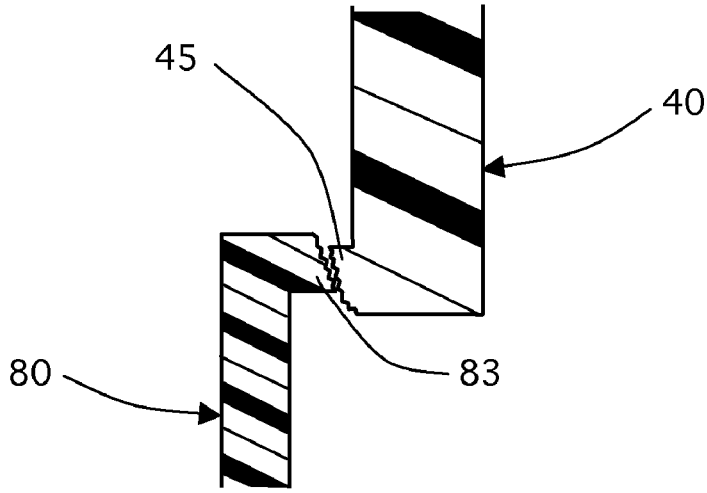
FIG. 5A is an enlarged elevational cross-section of lip 45 and detent 83 as seen in FIG. 5.

Movable spout assembly 60 includes a headed end 61 with an underside 63 from which spout outer and inner annular members 66 and 67 perpendicularly extend. The disposition of members 66 and 67 is such as to cooperate with central and inner annular members 26 and 27, guiding assembly 60 coaxially with respect to assembly 20. Headed end 61 includes centrally disposed valve seat 64 that is kept in place with spacer member 65, as best seen in FIG. 4. Detent or stopper lip 69; 69' prevent assembly 60 from falling as they coact with flange 26'.

Activator assembly 80 basically provides for a bottom wall 81 that is transversally suspended with respect to the longitudinal axis of neck N. In one of the preferred embodiments, an upper flange member 85 is mounted over the rim R of container C and several supporting legs 87 are mounted perpendicularly from member 85. Wall 81 is provided with puncturing protrusions 84 to cut through sheet 49 to permit the dispersion of the composition. Stored inside compartment assembly 40.

In operation, a container C that includes the present invention looks like what is shown in FIG. 1, before the composition is dispersed. In fact, the configuration shown in FIG. 1 corresponds to the storage or transportation position. When a user removes cover assembly 100 and pushes shaft end 42 down, lip 45 of assembly 40 is cammingly dislodged from its detent or stopper 83 and locks in the lowermost position with detent 83' where it is lodged. Sheet 49 is ruptured by puncturing protrusions 84 and the composition dispersed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cap for containers having a neck with a rim at an end of said neck defining an opening, comprising:

A) a collar assembly including an upper wall with a central through opening and a peripheral round edge, and said collar assembly a peripheral skirt extending perpendicularly from said edge and said skirt being mounted to said neck, adjacent to said opening, and said collar assembly further including first, second and third annular members perpendicularly extending from said upper wall and each having a distal end, in said opposite direction from said skirt, at predetermined respective distances from said round edge, and kept at a parallel and predetermined spaced apart relationship with respect to each other with said first annular member being closest to said edge and said third annular member defining said central opening therein and a passage therethrough, said third annular member includes an inwardly extending peripheral flange defining a narrower space;

B) compartment means for storing a composition to be dispersed to said contents of said container, said compartment including first and second ends, said first end including a plunger shaft that is receivable within said passage and cooperatively positioned to travel between first and second compartment extreme positions, said second end having an end opening and a sheet covering said end opening, said compartment means further comprising a lip, said plunger shaft includes a narrower portion for cooperative engagement of said plunger shaft to said peripheral flange in said first compartment extreme position and cooperative separation of said peripheral flange from said narrow portion when in said second compartment extreme position, said first compartment extreme position used during storage and transportation of said composition;

C) spout means coaxially mounted to said collar assembly and movable between first and second spout extreme positions, said spout means including a valve seat for selectively opening said passage when in said spout first extreme position and closing said passage by coming in cooperative abutting contact with said distal end of said third annular member when in said second spout extreme position; and D) activation means for rupturing said sheet when said compartment means is brought to said second compartment extreme position so that said composition is dispersed with said contents of said container and thereby selectively permitting a user to shake said container for mixing its contents without spillage when said spout means is at said second spout extreme position and allowing a user to withdraw said contents of said container when in said spout first extreme position and said compartment means is at said second compartment extreme position, said activation means comprises an activator assembly that is transversally suspended with respect to a longitudinal axis of said neck, said activator assembly comprises an upper flange member that is mounted over said rim and supporting legs mounted from said upper flange member, said activator assembly further comprises a lower wall having a plurality of conical puncturing protrusions to cut through said sheet to permit said dispersion of said composition through said sheet and through a plurality of openings in each puncturing protrusion, said activator assembly further comprises a detent to receive said lip when said compartment means is at said second compartment extreme position to lock said compartment means in said second compartment extreme position.

2. The cap for containers having a neck with a rim at an end of said neck defining an opening set forth in claim 1, further characterized in that said at least one puncturing protrusion is kept at a spaced apart relationship with respect to said sheet at said first compartment extreme position and positioned so that said puncturing protrusion ruptures said sheet in said second compartment extreme position.

3. The cap for containers having a neck with a rim at an end of said neck defining an opening set forth in claim 2, further comprising protective cover means mounted to said first annular member.

4. The cap for containers having a neck with a rim at an end of said neck defining an opening set forth in claim 3, further characterized in that said spout means are mounted to said second and third annular members, and said second annular member includes detent means for preventing said disengagement of said spout means from said second and third annular members.

* * * * *